US008881572B2

(12) United States Patent
Brüggenbrock et al.

(10) Patent No.: US 8,881,572 B2
(45) Date of Patent: Nov. 11, 2014

(54) SUPPORTING CORE FOR PRODUCING HOLLOW PROFILED ELEMENTS

(75) Inventors: Michael Brüggenbrock, Rosendahl (DE); Thomas Flehmig, Ratingen (DE); Jörg Gorschlüter, Hamm (DE); Harald Silz, Unterlangenstadt (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 800 days.

(21) Appl. No.: 12/990,884

(22) PCT Filed: Apr. 29, 2009

(86) PCT No.: PCT/EP2009/055230
§ 371 (c)(1),
(2), (4) Date: Dec. 8, 2010

(87) PCT Pub. No.: WO2009/135796
PCT Pub. Date: Nov. 12, 2009

(65) Prior Publication Data

US 2011/0088443 A1 Apr. 21, 2011
US 2011/0265536 A2 Nov. 3, 2011

(30) Foreign Application Priority Data

May 6, 2008 (DE) ..... 10 2008 022 402

(51) Int. Cl.
*B21D 9/03* (2006.01)
*B21C 37/16* (2006.01)

(52) U.S. Cl.
CPC .. *B21D 9/03* (2013.01); *B21C 37/16* (2013.01)
USPC ..... 72/466.2; 72/51; 72/393

(58) Field of Classification Search
CPC ..... B21D 9/03
USPC ..... 72/150, 393, 466, 466.2, 466.8, 479, 72/127, 166, 169, 51, 52; 403/122, 141, 403/142, 143; 279/57, 74, 82
See application file for complete search history.

(56) References Cited

U.S. PATENT DOCUMENTS 553,608 A * 1/1896 Conners ..... 72/466
1,387,199 A 8/1921 Small (Continued)

FOREIGN PATENT DOCUMENTS

DE 37007 3/1886
DE 562 804 C 10/1932

(Continued)

OTHER PUBLICATIONS

International Search Report for PCT International Application No. PCT/EP2009/055230, Aug. 2009.

(Continued)

*Primary Examiner* — Edward Tolan
(74) *Attorney, Agent, or Firm* — Proskauer Rose LLP

(57) ABSTRACT

A supporting core for using in a device for forming plates into a structured hollow profile and a method for producing structured hollow profiles from a plate, which on the one hand ensures an all-over support of the plate, and still enables the production of hollow profiles with a variable cross-section or a curved course, is provided by including individual supporting members, which when pushed together at least in part form as a surface an inner contour of the hollow profile to be produced and are interconnected by means of coupling elements, wherein the coupling elements allow the supporting members to be pulled-apart, and wherein the supporting members are interconnected in a hinged manner in the pulled-apart position.

5 Claims, 2 Drawing Sheets

(56) References Cited

U.S. PATENT DOCUMENTS

| | | | | | |
|---|---|---|---|---|---|
| 1,534,314 | A | | 4/1923 | Heintz | |
| 1,748,158 | A | * | 2/1930 | Walp | 72/466 |
| 1,995,368 | A | * | 3/1935 | Sunnen | 219/61.1 |
| 2,103,574 | A | * | 12/1937 | Wintercorn | 72/96 |
| 2,776,697 | A | * | 1/1957 | Zerlaut | 72/466 |
| 2,962,077 | A | * | 11/1960 | Condiff | 72/466 |
| 2,984,284 | A | * | 5/1961 | Ballard | 72/466 |
| 3,417,601 | A | * | 12/1968 | Werner | 72/465.1 |
| 3,750,455 | A | * | 8/1973 | Stange et al. | 72/466 |
| 3,879,994 | A | * | 4/1975 | Hume | 72/127 |
| 3,973,717 | A | | 8/1976 | Jensen | |
| 4,123,930 | A | | 11/1978 | Hill et al. | |
| 4,378,689 | A | | 4/1983 | Molz | |
| 4,475,375 | A | * | 10/1984 | Hill | 72/466 |
| 4,635,464 | A | * | 1/1987 | McGuire et al. | 72/466 |
| 4,716,753 | A | * | 1/1988 | Martin | 72/122 |
| 4,744,233 | A | * | 5/1988 | Trudell | 72/150 |
| 5,245,849 | A | * | 9/1993 | Hume | 72/155 |
| 6,244,092 | B1 | * | 6/2001 | Grobbenhaar | 72/466.2 |
| 7,219,527 | B2 | * | 5/2007 | Yogo | 72/466.2 |
| 2003/0180088 | A1 | * | 9/2003 | Camevali | 403/56 |

FOREIGN PATENT DOCUMENTS

| | | | | | |
|---|---|---|---|---|---|
| DE | 1527318 | | | 3/1970 | |
| DE | 3000170 | A1 | | 7/1981 | |
| DE | 276043 | A1 | | 2/1990 | |
| JP | 55-70420 | A | * | 5/1980 | B21D 5/01 |
| JP | 62 20710 | | | 2/1987 | |
| JP | 03193220 | A | | 8/1991 | |
| JP | 2001-121217 | | | 5/2001 | |
| JP | 2008-006450 | | | 1/2008 | |
| SU | 740 344 | A1 | | 6/1980 | |
| SU | 1397121 | A2 | * | 5/1988 | B21D 9/01 |
| WO | 95/02474 | A1 | * | 1/1995 | B21C 37/18 |
| WO | 01/41949 | A | | 6/2001 | |

OTHER PUBLICATIONS

English language translation of DE 562804C, Oct. 1932.

English language translation of SU 740 344 A1, Jun. 1980.

English language translation of DD 276043A1, Feb. 1990.

English Language translation of JP 62 20710, Feb. 1987.

* cited by examiner

SUPPORTING CORE FOR PRODUCING HOLLOW PROFILED ELEMENTS

CROSS-REFERENCE TO RELATED APPLICATIONS

This application is a National Phase Application of International Patent Application No. PCT/EP2009/055230, filed on Apr. 29, 2009, which claims the benefit and priority to German Patent Application No. DE 10 2008 022 402.2-14 filed on May 6, 2008, which is owned by the assignee of the instant application. The disclosure of each of these applications is incorporated herein by reference in its entirety.

FIELD OF THE INVENTION

The invention relates to a supporting core for use in a device for forming plates into a structured hollow profile, comprising a plurality of interconnected supporting members, and to a method for producing structured hollow profiles from a plate.

BACKGROUND

In the manufacture of structured hollow profiles using discontinuous methods, for example by means of U-O forming or by using a rolling-in technique, supporting cores are needed which correspond as far as possible to the inner contour of the hollow profiles. The supporting cores must be able to withstand the forming forces during the molding of the plates without significant deformation, in order to allow accurate forming of the inner contour of the hollow profile. Curved hollow profiles or hollow profiles with varying cross-sections no longer allow the use of a rigid supporting core. While supporting cores consisting of an elastomer are able to support the full surface of the inner contour, they are only able to withstand the great forming forces to a limited extent. Especially, locally occurring, very high surface pressings are a problem here. A further problem with supporting cores consisting of an elastomer is that the bending capability of the elastomer drops with increasing hardness, so that either problems arise when pulling the core, due to the reduced bending capability, or the shape retention following insertion of the supporting core is incomplete. Finally, it must be mentioned that wear of the elastomer allows only small numbers of structured hollow profiles to be produced before they need to be replaced.

From German published application DE 30 00 170 A1, a core is also known for use during pipe bending, which comprises a plurality of interconnected supporting members. The problem with this core is that it has a relatively complex design and does not allow full-surface support, as is required for the production of structured hollow profiles.

SUMMARY OF THE INVENTION

In general, an aspect of the present invention is to provide a supporting core for use in the production of structured hollow profiles, which on the one hand ensures full-surface support of the plate but still allows the production of hollow profiles with a variable cross-section or a curved form. In addition, a method for producing structured hollow profiles is to be proposed.

According to a first teaching of the present invention, the aspect set out above is achieved in that the individual supporting members when being pushed together at least in part form as a surface the inner contour of the hollow profile to be produced and are interconnected by means of coupling elements, wherein the coupling elements allow the supporting members to be pulled apart, wherein the supporting members are interconnected in a hinged manner in the pulled-apart state.

Lined-up like on a pearl necklace, the supporting members of the supporting core according to the invention can be pulled apart as the supporting core is pulled so that during pulling they are kept apart from one another in a certain distance. In this position, the supporting members of the supporting core according to the invention are interconnected in a hinged manner, so that they can be angled against each other. This allows the supporting members of the supporting core as the supporting core is pulled to follow the shape of the hollow profile and pulling of the supporting core is enabled despite the curved course of the hollow profile or a variable cross-section. When being pushed together, the supporting members at least in part form as a surface the inner contour of the hollow profile to be produced and thereby enable an accurate forming of the inner contour. Preferably, the supporting members are thereby detachably connected together via coupling elements, so that the supporting core can be adapted to other hollow profiles in the contours by using different supporting members. The axial length of the supporting members of the supporting core is typically selected in such a way that the structure of the supporting core is as simple as possible. On the other hand, through a shorter length of the supporting members, simple pulling of the supporting core after forming can be supported.

According to a first embodiment of the present invention, a simplified supporting core can be provided in that the coupling elements of the supporting members comprise an extension with a form-fit area and an opening for the form-fitting accommodation of the extension and the form-fit area. The form-fit guarantees in a simple way that when pulling the supporting core all supporting members can be pulled out of the hollow profile produced.

If according to another embodiment of the supporting core according to the invention, the form-fit area of the extension has a spherical design, this can be angled in a pulled-apart position in all spatial directions without losing the form-fit. A correspondingly equipped supporting core according to the invention is, therefore, particularly flexible in its use. It is also conceivable, however, for the form-fit area of the extension to be given another geometrical form, such as a conical form, in order to allow angling.

According to another embodiment of the supporting core according to the invention, the end faces of the supporting members are designed as axial supporting surfaces. By means of these supporting surfaces the supporting core can be loaded with forces in axial direction so that the supporting core is axially braced and can thus provide a higher resistance against the forming forces during forming.

Finally, the supporting core according to the invention can be advantageously designed in that the supporting members, when abutting via the end faces, form the full inner contour of the hollow profile to be formed. The forming accuracy during production of the structured hollow profile can be further improved in this way.

According to a second teaching of the present invention, the aspect set out above for a method for producing structured hollow profile from a plate is achieved in that a supporting core according to the invention is used.

As already stated above, the supporting core according to the invention, on the one hand, allows reliable forming of the plate into a structured hollow profile and, on the other hand, allows simplified pulling of the supporting core after the forming.

As a result, the method according to the invention, by using the supporting core according to the invention, allows a simplified production process for structured hollow profiles with greater forming accuracy and yet a high degree of flexibility with regard to forming the hollow profiles.

According to a first embodiment of the method according to the invention, the plate is initially formed into a U-shape and the supporting core is introduced into the U-shaped plate, wherein at one end of a U-shaped die, in which the U-shaped plate is located, a stop for the supporting core is provided, against which the supporting core at least during forming is pressed through the application of a force in the axial direction. Use of the stop is a simple option for putting the supporting core under pressure in the axial direction, so that the moveable supporting members of the supporting core can withstand additional resistance against the forming forces during forming of the U-shaped plate into a hollow profile.

According to a simplified embodiment of the method according to the invention, the supporting core is introduced into the U-shaped plate in the pulled-apart state, by means of an axially directed force the individual supporting members are pushed together and via their end faces these are subjected to an axial force. The end faces in most cases provide large contact surfaces between the individual supporting members, so that the supporting core can be loaded with relatively high axial forces in the axial direction.

If after the forming of the U-shaped plate into a structured hollow profile the supporting core is pulled, wherein the individual supporting members during pulling are pulled-apart via the form-fit area of the coupling elements and are pulled out of the hollow profile in the pulled-apart state, this allows the supporting core to be removed easily from the hollow profile produced. The supporting members of the supporting core in the pulled-apart state are then in a moveable position and can, for example, follow the curved shape of the hollow profile without any problem.

Finally, a particularly economical and rational method for producing structured hollow profile can be provided in that the plate is formed into a hollow profile by means of U-O forming or by using a rolling-in technique.

BRIEF DESCRIPTION OF THE DRAWINGS

There are now a number of possible embodiments of the supporting core according to the invention and the method according to the invention. For this document, reference is made to the description of an exemplary embodiment in conjunction with the drawing. In the drawings.

DESCRIPTION

Figure 1:
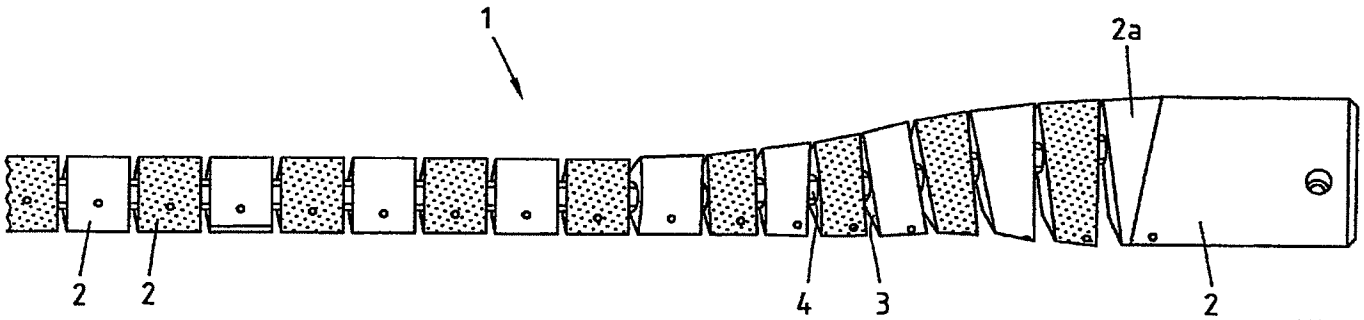
FIG. 1 shows an exemplary embodiment of the supporting core according to the invention in the pulled-apart state in a perspective side-view.

FIG. 1 now shows a perspective side-view of an exemplary embodiment of a supporting core 1 according to the invention comprising a plurality of individual supporting members 2. The supporting core 1 is shown in FIG. 1 in the pulled-apart state, so that the contact surfaces 3 of the individual supporting members 2 and the coupling elements 4 are visible. To simplify the representation of the supporting core 1 being constructed from a plurality of supporting members, the supporting members have different colors. As can be seen from the pulled-apart supporting members 2, apart from two end faces these also have a different form in the axial direction. Thus, for example, the first member 2*a* of the supporting core 1 has a wedge-shape, in order in the pushed-together state to bring about, for example, a curving of the supporting core 1. The supporting members 2 are therefore designed in such a way that when the supporting members are abutting at their respective end faces the supporting core 1 forms at least in part the inner contour of the hollow profile to be produced.

Figure 2:
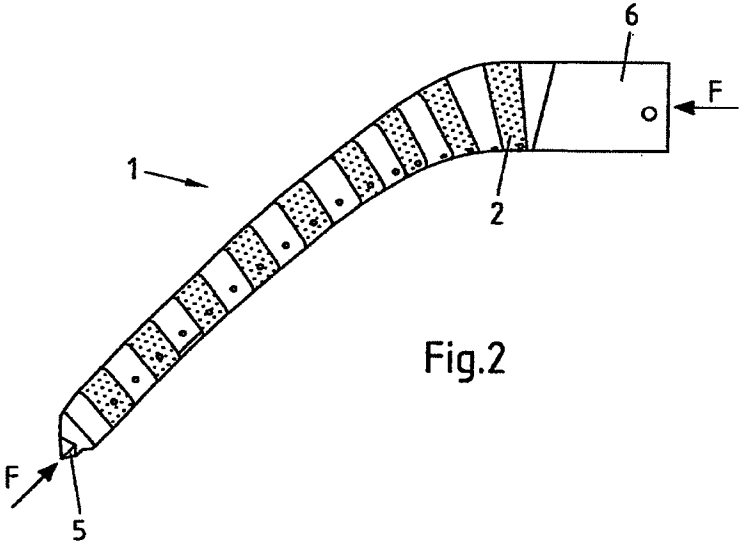
FIG. 2 shows the supporting core from FIG. 1 in the pushed-together state and FIG. 3 shows a perspective view of an exemplary embodiment of the coupling elements of the supporting core from FIG. 1.

This is shown by FIG. 2 in a perspective view of the pushed-together supporting core 1. In the pushed-together state, the supporting core is curved and corresponds to the inner contour of the hollow profile to be produced. The first member 5 of the supporting core 1 also has a centering device which is used for abutting against a stop. If the supporting core is loaded with a force on the supporting members 5, 6 in the direction of the arrow and in this respect if the supporting members 2 is loaded with an axial force in the axial direction, the supporting core forms a core withstanding the forming forces, which after shaping in the direction of the member 6 can be removed from the formed hollow profile.

Figure 3:
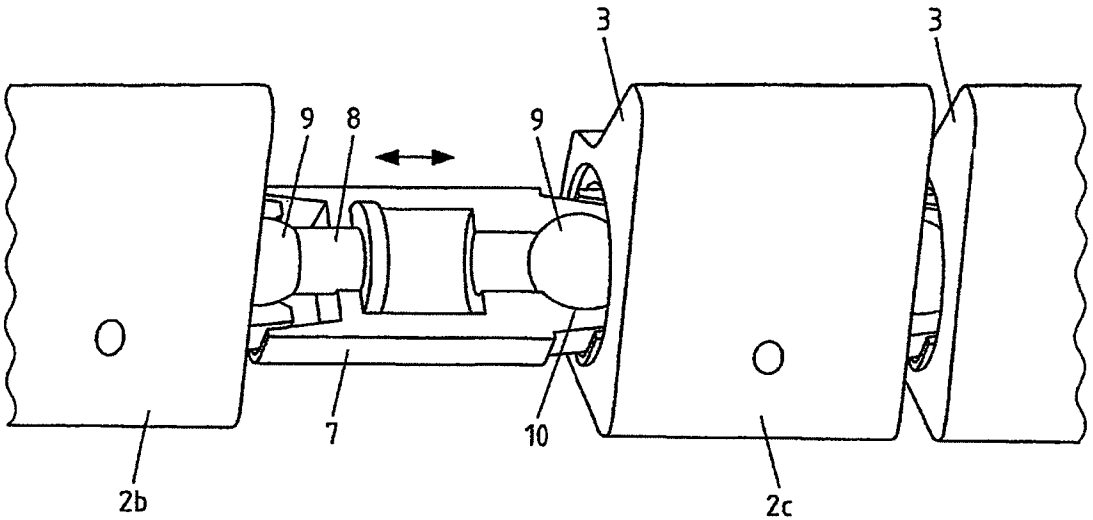

FIG. 3 is a perspective view of the structure of the coupling element 7, which on its side turned towards the member 2*b* of the supporting core 1 has an extension 8, which comprises a spherical form-fit area 9. The spherical form-fit area 9 engages in an opening 10 provided by the next coupling element. The position of the extension 8 can be varied in the coupling element 7, so that both a pushing together and a pulling apart of the supporting members 2 of the supporting core are possible. By means of the spherical form-fit area 9 of the extension 8 the supporting members of the supporting core can be angled against each other or also rotated in the pulled-apart state. This allows a simple pulling of the supporting core, for example also when bent or, respectively, curved hollow profiles are to be produced.

Overall, the production of structured hollow profiles is simplified considerably by the use of the supporting core according to the invention and allows accurate forming of the form of the supporting core.

The invention claimed is:

1. Method for producing structured hollow profiles from a plate, wherein a supporting core comprises a plurality of interconnected supporting members is used for forming a plate into a structured hollow profile, wherein the individual supporting members when being pushed together at least in part form as a surface an inner contour of the hollow profile to be produced and are interconnected by means of coupling elements, wherein the coupling elements allow the supporting members to be pulled apart, and wherein the supporting members are interconnected in a hinged manner that allows for rotation of the supporting members in the pulled-apart position.

2. Method according to claim 1, wherein the plate is formed into a U-shape and the supporting core is introduced into the U-shaped plate, wherein at one end of a U-shaped die, in which the U-shaped plate is located, a stop for the supporting core is provided, against which the supporting core at least during forming is put under pressure in the axial direction.

3. Method according to claim 2, wherein the supporting core is introduced into the U-shaped plate in a pulled-apart state, by means of an axially directed force the individual supporting members are pushed together and via their end faces these are subjected to an axial force.

4. Method according to claim 3, wherein after the forming of the U-shaped plate into a structured hollow profile the supporting core is pulled, wherein the individual supporting members during pulling are pulled apart via a form-fit area of the coupling elements and are pulled out of the hollow profile in the pulled-apart state.

5. Method according to claim 1, wherein by means of U-O forming or by using a rolling-in technique the plate is formed into a hollow profile.

* * * * *